US005147450A

United States Patent [19]

Mikucki et al.

[11] Patent Number: 5,147,450

[45] Date of Patent: Sep. 15, 1992

[54] PROCESS FOR PURIFYING MAGNESIUM

[75] Inventors: Barry A. Mikucki, Lake Jackson; James E. Hillis, Angleton, both of Tex.

[73] Assignee: The Dow Chemical Company, Midland, Mich.

[21] Appl. No.: 736,195

[22] Filed: Jul. 26, 1991

[51] Int. Cl.[5] ..... C22B 26/22

[52] U.S. Cl. ..... 75/601; 75/603

[58] Field of Search ..... 75/600, 601, 602, 603

[56] References Cited

U.S. PATENT DOCUMENTS

| | | | |
|---|---|---|---|
| 3,737,305 | 6/1973 | Blayden et al. . | |
| 3,849,119 | 11/1974 | Bruno et al. . | |
| 3,854,934 | 12/1974 | Dore et al. . | |
| 3,869,749 | 9/1989 | Fioravanti et al. . | |
| 3,870,511 | 3/1975 | Szekely . | |
| 4,067,731 | 1/1977 | Chia . | |
| 4,556,419 | 12/1985 | Otsuka et al. . | |
| 4,670,050 | 6/1987 | Ootsuka et al. . | |
| 4,714,494 | 12/1987 | Eckert . | |
| 4,738,717 | 4/1988 | Dokken . | |
| 4,772,319 | 9/1988 | Otsuka et al. . | |
| 4,891,065 | 1/1990 | Green et al. | 75/601 |
| 4,959,101 | 9/1990 | MacNeal et al. | 75/685 |

FOREIGN PATENT DOCUMENTS

| | | | |
|---|---|---|---|
| 1353011 | 1/1964 | France | 75/601 |

OTHER PUBLICATIONS

D. V. Neff, "Nonferrous Molten Metal Processes," *Metals Handbook*, 9th Edition, vol. 15/Casting, Editors: D. M. Stefauescu et al., ASM International, Metals Park, Ohio, 1988, pp. 456–465, 485, and 486.

E. F. Emley, *Principles of Magnesium Technology*, Pergamon Press, Inc, New York, N.Y., 1966, pp. 191–200 and 261–264.

R. J. Fruehan, "Gases in Metals," Metals Handbook, 9th Edition, vol. 15/Casting, Editors: D. M. Stefauescu et al., ASM International, Metal Parks, Ohio, 1988, pp. 82–87.

*Primary Examiner*—Melvyn J. Andrews

[57] ABSTRACT

Hydrogen is essentially removed from molten magnesium by the use of a degassing step, thereby substantially avoiding the formation of zirconium hydride when zirconium and silicon are added to the molten magnesium, after the degassing, in order to precipitate iron contamination in the magnesium as an intermetallic compound comprising Fe, Zr, and Si; the ratio of the three metals in the intermetallic compound can vary over a wide range. By essentially avoiding the formation of slow-settling insoluble $ZrH_2$, the iron removal is more efficient and the settling of the insolubles is expedited. Also, the Fe and Si are more effectively and consistently precipitated.

26 Claims, 3 Drawing Sheets

Figure 1a
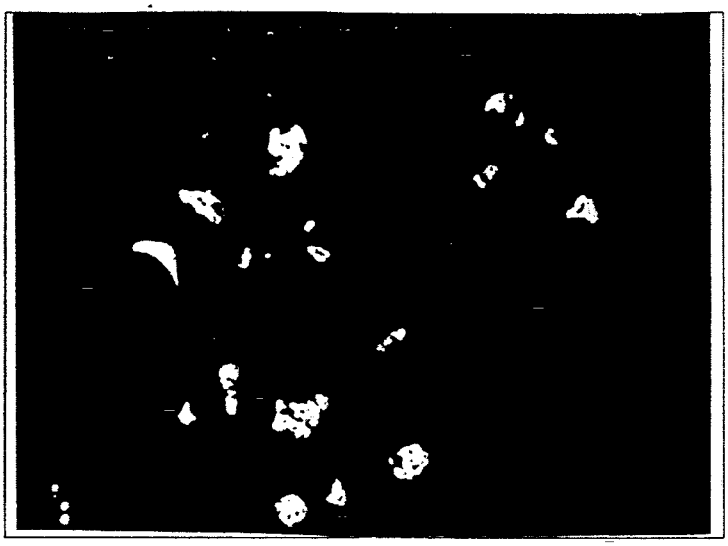
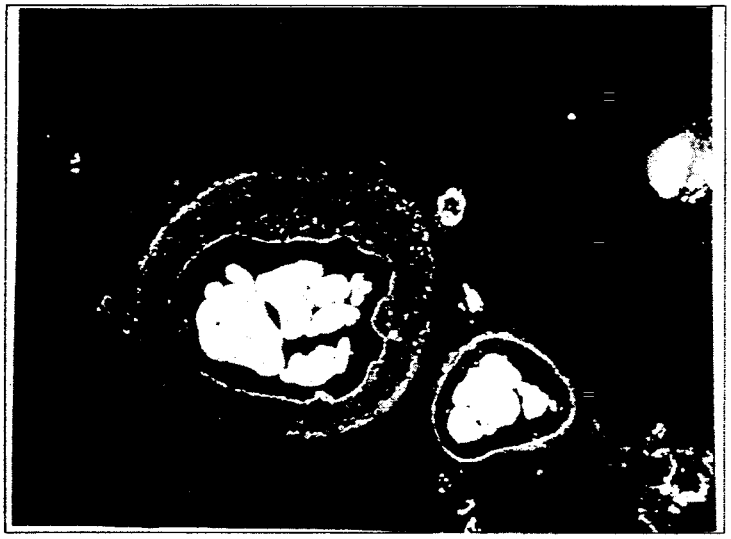
Figure 1b
Figure 1c
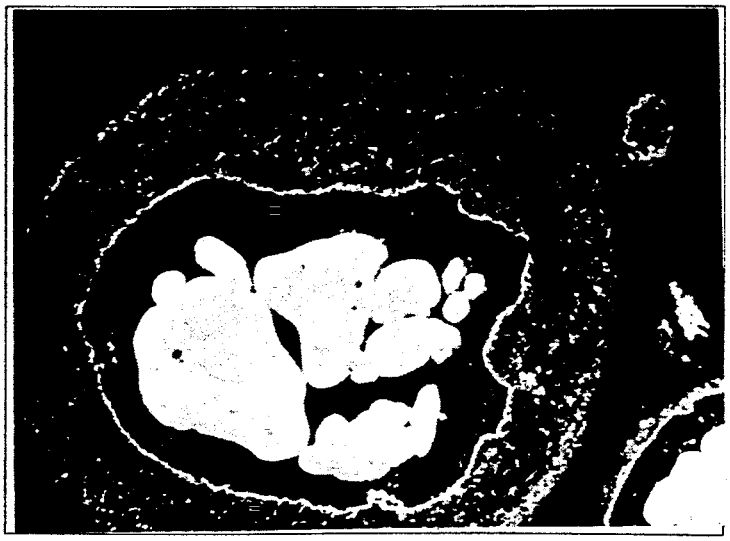

PROCESS FOR PURIFYING MAGNESIUM

FIELD OF THE INVENTION

An improvement in the use of Zr and Si for reducing iron contamination in magnesium is disclosed.

CROSS-REFERENCE TO RELATED APPLICATION

This application is related, in part, to pending application Ser. No. 07/449,234, filed Dec. 6, 1989.

BACKGROUND OF THE INVENTION

This is an improvement in the process disclosed in U.S. Pat. No. 4,891,065 in which iron impurities in molten magnesium are lowered by using a binary intermetallic phase of a zirconium material and a silicon material as an iron precipitating agent for the purpose of purifying the magnesium. U.S. Pat. No. 4,891,065 (hereinafter referred to as the '065 patent) is included herein by reference in its entirety.

The Zr/Si binary intermetallic phase is typically formed by contacting a zirconium material and silicon material within a magnesium melt. Whereas the Zr/Si intermetallic phase is effective in reducing the Fe in Mg by precipitation thereof as a ternary intermetallic compound, Fe/Zr/Si, we have found that the presence of dissolved hydrogen in the magnesium hinders or reduces the efficient formation of the Zr/Si intermetallic phase due to the formation of Zr hydride, $ZrH_2$. Furthermore, the $ZrH_2$ is formed as a very fine particulate which settles very slowly. The binary intermetallic of Zr/Si and the ternary intermetallic of Fe/Si/Zr settle rapidly due to their high density and favorable morphology. The settling rate of the $ZrH_2$ is several times slower than that of the binary and ternary intermetallic compounds; the slow settling rate of the $ZrH_2$ is detrimental to the efficiency of large scale production of the desired high purity, low iron Mg product.

The dissolved hydrogen in the molten Mg can occur as the result of, e.g., electrolytic decomposition of moisture which can enter the electrolytic production of magnesium, from atmospheric humidity which can come into contact with the Mg, (esp. hot or molten Mg), wet melt fluxes, hydrogen-containing species in the molten cell bath, or contact of molten Mg with hydrocarbons. Moisture can react with hot Mg to form MgO and hydrogen. The solubility of hydrogen in the molten Mg increases as the temperature of the Mg is increased. The hotter the molten Mg in the range normally used for producing, holding, or casting the Mg (between about its 650° C. m.p. to about its 1107° C. b.p.) the more hydrogen can dissolve in it, albeit, in low parts per million concentration. The small solubility of hydrogen in molten Mg, expressed in units of weight concentration, is due to the low atomic weight of hydrogen. The solubility of hydrogen in molten Mg, expressed on an atomic ratio basis (atoms of H per atom of Mg), is on the order of about 0.0015 at 775° C., an amount which is not negligible. Cooling of hot Mg to a lower temperature exudes some of the hydrogen that may be in the Mg as an impurity. Even at 650° C., the freezing point of the metal, the Mg can still contain substantial quantities of dissolved hydrogen. The atomic ratio of hydrogen to Mg at 650° C. for a fully saturated metal is about 0.009. However, if a Zr material and a Si material have been added to the Mg, the contaminating hydrogen tends to react with the Zr to form $ZrH_2$ and interfers with the desired production of Fe/Zr/Si and Zr/Si intermetallics, thus counter-acting, to some degree, the purpose of adding the Zr material and the Si material in the first place.

In order to better assure the absence of hydrogen in the molten Mg, especially in large production vessels where complete exclusion of hydrogen or hydrogen sources is not economically feasible, the present improvement in the process of U.S. Pat. No. 4,891,065 has been developed.

It is an object of this invention to provide an improvement in the process of purifying Mg, especially for use as an essentially pure starting material or reagent for use, e.g., in making U, Ti, Zr, or Mg compounds or Mg alloys with other metals.

SUMMARY OF THE INVENTION

The process of using a binary intermetallic phase of Zr/Si as a precipitating agent for removing Fe from molten magnesium which contains hydrogen is improved by degassing the magnesium. After the degassing, which essentially removes hydrogen, a Zr-containing material and Si-containing material are introduced to form intermetallic phases of Zr/Si and Fe/Si/Zr in the Mg. By assuring the substantial absence of hydrogen in the molten Mg, the beneficial effects desired from the effects of the Zr/Si reagent are realized and the possibility of forming $ZrH_2$ is appreciably decreased, giving rise to more efficient and rapid precipitation of the ternary intermetallic phase of Fe/Si/Zr.

BRIEF DESCRIPTION OF FIGS. 1*a* TO 5

FIGS. 1*a* to 4 are photomicrographs of some samples which are described in examples hereinafter. The photomicrographs are provided as visual aids for explaining and describing the invention. FIG. 5 is a graph of some analytical results of comparative examples, provided for the same purpose.

DETAILED DESCRIPTIONS INCLUDING BEST MODE KNOWN

In U.S. Pat. No. 4,891,065 a binary intermetallic phase is formed by contacting a Zr material and a Si material within a Mg melt, at a ratio sufficient to control the mutual solubilities of Zr and Si in the Mg melt. When a Mg melt containing soluble Fe is contacted with the binary intermetallic phase, a ternary intermetallic precipitate consisting essentially of Zr, Si, and Fe is formed. The so-formed ternary intermetallic phases are separated from the Mg melt, for example, by settling.

We have now improved on the process described in U.S. Pat. No. 4,891,065 by de-gassing the Mg in order to remove hydrogen before introduction of the Zr and Si, thereby essentially avoiding the formation of deleterious amounts of $ZrH_2$. We have found that dissolved hydrogen gas causes difficulty with respect to controlling the soluble Si and Fe levels present in the Mg product. Also, the $ZrH_2$ that is formed is difficult to separate from the Mg melt, resulting in slow production rates or high levels of insoluble Zr in the product Mg. Furthermore, the presence and quantity of hydrogen in Mg is very difficult to determine in production scale processes, thus there is an incentive to assure the substantial absence of hydrogen before adding the Si material and Zr material to the molten Mg to precipitate the Fe.

In the present invention, prior to treating the molten Mg with Zr and Si reagents, the molten metal is degassed to remove at least a portion of the dissolved hydrogen gas. The degassing may be done, for example, by gas purging, vacuum fluxing, plunging hexachloroethane tablets into the melt, rotary impeller degassing, and porous plug degassing. Gas purging may be done using a gas which is essentially non-reactive with the Mg in order to avoid producing needless side products of Mg. Also purging may be done using a mixture of gases, including e.g., a mixture of an inert gas and a gas which reacts with the hydrogen and the Mg. Argon (including argon mixed with other gases, such as reactive chlorine) is a preferred sparging gas for purging the hydrogen from the molten Mg. The hydrogen degassing treatment of the present invention results in a more consistent Mg product (the levels of soluble Fe and Si are more easily controlled) and greater production rates. If the degassing is not performed, any $ZrH_2$ formed in the process settles at a rate which is considerably slower than the rate needed for efficient production rates. Even then, large production size batches will usually retain some of the insoluble $ZrH_2$.

The expression "low iron Mg" refers to Mg having less than about 100 ppm residual Fe, preferably less than about 70 ppm Fe, most preferably less than about 60 ppm Fe.

The expression "high purity magnesium" refers to Mg having not only "low iron", but also not more than about 100 ppm each of any other metallic residuals, preferably less than about 70 ppm each, most preferably less than about 50 ppm each.

The expression "metallic residuals" includes not only metals per se, but also metals in the form of compounds, or intermetallic compounds, or soluble metals.

To demonstrate the use of a sparging gas to remove H from molten Mg, known quantities of H are intentionally added in order to more readily quantify the analytical results regarding the formation of $ZrH_2$.

In the examples below, the Mg which is employed is typically produced by electrolytic methods and usually contains about 300 to 450 ppm of soluble Fe. The Mg can contain various levels of H depending on the amount of exposure of the Mg at elevated temperatures to air, water, or other H sources such as thermally or electrolytically decomposed H-containing compounds.

The Mg/Zr binary employed as the source of Zr for use in the removal of Fe from molten Mg can be (but not necessarily) of the kind which is available from Teledyne Whah Chang which is nominally about 67% Zr and about 33% Mg, based on density measurements. The Mg/Zr binary is normally a granular material of particles sizes within the range of about 1.9 cm down to about +20 mesh (U.S. Standard Sieve Size).

The Si metal reagent employed is usually (but not necessarily) a fine powder which is predominantly in the particle size range smaller than 4 mesh, mostly −16 by +20 mesh (U.S. Standard Sieve Size).

Attached FIGS. 1*a*, 1*b*, 1*c*, 2, 3, and 4 are photomicrographs of various magnifications of precipitates which are discussed in the examples below. FIG. 5 is a graph of curves based on a sample of a melt which has been de-gassed in comparison to a sample of a melt which has not been de-gassed. The sample which has been de-gassed has a much faster settling rate, a feature which is very important in having an efficient and expedient large scale process.

FIG. 1*a* is a 100× magnification of a sectioned sample having precipitates which shows the $ZrH_2$ as white clusters coated by "halos" of binary and ternary intermetallic compounds to form beads. Some of the randomly arranged beads are viewed in cross-section.

FIG. 1*b* is a 500× magnification showing some sliced beads in greater detail.

FIG. 1*c* is a 1000× magnification of the same beads as shown in FIG. 1*b*. In FIG. 1*c* the halo is clearly seen as a crust-like coating around the $ZrH_2$.

Figure 5:
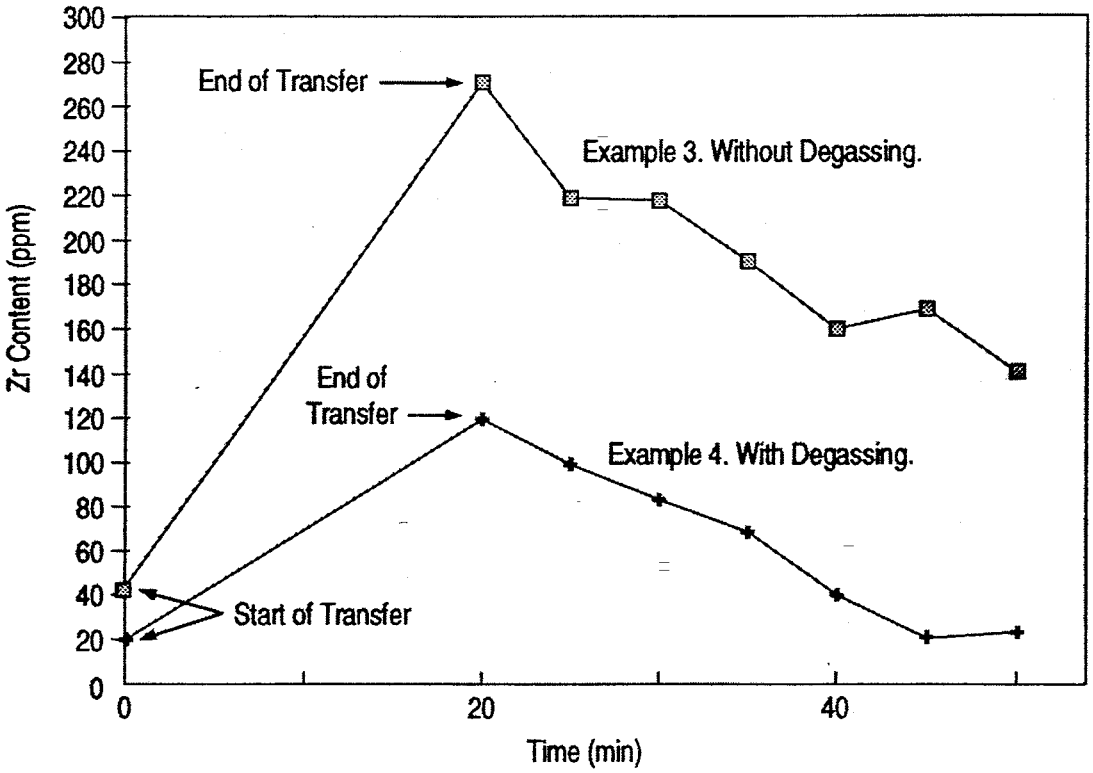

FIG. 5 shows a graph of the Zr content of molten Mg within a large reverberatory furnace as a function of time. Metal is added to the furnace at time=0 minutes. The metal addition to the furnace is completed at time=20 minutes. The metal addition causes the furnace contents to be agitated. The graph indicates the amount of $ZrH_2$ present within the furnace and the rate at which the $ZrH_2$ settles.

EXAMPLE 1: (example of invention to compare with Ex. 1A)

Two hundred lbs. (90.72 Kg) of Mg, containing about 380 ppm Fe, is melted in a large steel crucible. The molten metal is protected from oxidation by using 25 pounds (11.34 Kg) of conventional magnesium protective flux having an approximate composition of 55 wt. % $MgCl_2$, 40 wt. % KCl, and 5 wt. % $CaF_2$. The melt temperature is brought to 800° C. Next, 550 liters of hydrogen gas are sparged into the molten metal through a hollow steel tube (0.64 cm ID), over a 3.25 hour time span, in order to saturate the Mg with dissolved hydrogen gas. Then the metal temperature is reduced to 700° C. (to assure it is saturated) and is sparged with 850 liters of argon over a 1 hour time period, in order to purge dissolved hydrogen from the melt. Porous plug degassing is used by sparing gas through a porous structure into the melt to assure fine bubble size. After degassing, 1500 ppm of Zr and 277 ppm of Si are added to the melt. The metal is stirred for 15 minutes using a mechanical mixer. After the stirring is shut off, a sample is obtained from the molten metal after 30 minutes of settling time, and the sample is analyzed by spark emission spectrophotometry. The analysis indicates that the Mg metal contains 58 ppm Fe, 7 ppm Zr, and 40 ppm Si.

Thus, a low-iron and high purity Mg product is successfully produced. At least a portion of the dissolved hydrogen gas is removed by the argon sparging of the melt. As a result, enough Zr is available to precipitate almost all of the Fe as a ternary Fe/Zr/Si complex.

EXAMPLE 1-A (for comparison with Ex. 1; not an example of the invention)

The procedure of example 1 above is repeated except that the argon sparging is omitted. The analysis indicates that the Mg contains 300 ppm Fe, <10 ppm Zr, and 128 ppm Si after 30 minutes of settling time.

Neither low-iron Mg nor high-purity Mg is produced. The Zr is precipitated as $ZrH_2$ which is removed by the long period of settling employed. Since the Zr is precipitated as $ZrH_2$, the Zr is not available to form the desired Zr/Si binary and Fe/Zr/Si ternary intermetallic particles. This results in high soluble Fe and Si contents in the Mg product.

EXAMPLE 2: (for comparison purposes, not an example of the invention)

Forty pounds (18.14 Kg) of Mg, containing about 380 ppm Fe, are melted in a 17.78 cm diameter by 43.18 cm long cylindrical steel container under a protective atmosphere of air/$CO_2$/$SF_6$. An electric resistance heated furnace is used to control the melt temperature at 700° C. The melt is sparged with six liters of propane gas through a hollow steel tube (ID=0.64 cm) over a 30 minute period of time, and the propane is rapidly pyrolyzed to carbon and hydrogen at the temperatures employed, in order to saturate the Mg with dissolved hydrogen. Next, 2500 ppm Zr and 550 ppm of Si are added. The metal is stirred for 10 minutes and subsequently held in a quiescent state for 2 hours in order to settle insoluble solid particles to the bottom of the melt. The heating elements are shut off, and the metal is allowed to solidify undisturbed to produce a billet.

The solid billet is removed from the steel container the next day. Pin samples (0.64 cm in diameter×5.08 cm long) are drilled from the top of the billet and analyzed by spark emission spectrophotometry. The samples are found to contain 60 ppm Fe, less than 10 ppm Zr, and 347 ppm Si.

Figure 2:
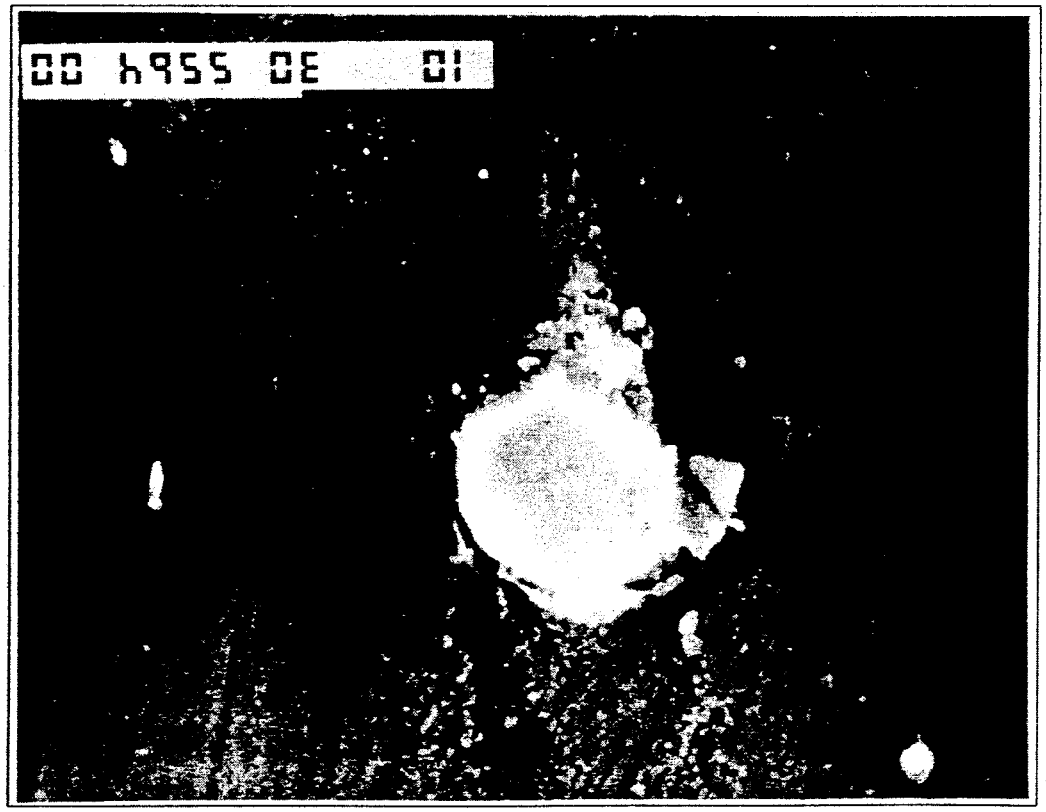
FIG. 2 is a 2,800× magnification to show iron particles evident in the sample.

The billet is sectioned for metallographic analysis. The billet is found to have a 1.91 cm thick layer along its bottom which is rich in settled intermetallic particles. The sectioned particles appear as many large ring structures (see FIGS. 1*a*, 1*b* and 1*c*). Scanning electron microscopy/energy dispersive x-ray analysis indicates that the center of the rings contain an agglomeration of 2 to 10 micron size particles rich in Zr. The outer portion of the ring contains a layer or "halo" of fine particles rich in Fe, Zr, and Si. Between the halo and the central Zr-rich particles, there is layer of elemental Mg. In addition to the ring structures, many cubic or diamond shaped pure alpha-iron particles are present in the settled layer along the bottom of the billet (see FIG. 2).

A sample from the bottom of the billet is dissolved in concentrated aqueous $NH_4Cl$ solution, and the insoluble black powder that is recovered is analyzed by powder x-ray diffraction (XRD). The major phase is identified by XRD as $ZrH_2$. No other phases are positively identified.

Transmission electron microscopy and electron diffraction analysis indicates that the rounded Zr-rich particles (found in the center of the ring structures) contain both Zr and hydrogen. No carbon, oxygen, or nitrogen is detected by microprobe analysis and quantitative wavelength dispersive spectroscopy. These analyses indicate that the Zr-rich particles contain 97.8+/−0.2 wt % Zr. $ZrH_2$ contains 97.9 wt % Zr. These results identify the Zr-rich phase in the center of the ring structures as $ZrH_2$, which is consistent with the XRD results shown above.

Neither low-iron Mg nor high-purity Mg is produced. The solubility of Fe in molten Mg at 650° C. is about 60 ppm. Since the billet is produced by solidification of molten Mg over a period of several hours, the metal would be expected to contain about 60 ppm Fe even if no Zr is added to it. Moreover, the alpha-iron particles present in the settled layer indicate that the majority of the Fe is not successfully precipitated as an Fe/Zr/Si ternary intermetallic compound. Microstructural analysis and XRD indicate that $ZrH_2$ is the dominant Zr phase formed. This suggests that as a result of hydrogen gas dissolved in the molten Mg, the Zr is precipitated as $ZrH_2$ to form the ring structures. Therefore, the Zr is not available to form the desired Zr/Si binary and Fe/Zr/Si ternary intermetallic particles. This causes the high soluble Si content.

EXAMPLE 2-A: (example of invention to compare with Ex.2)

Forty pounds (18.14 Kg) of Mg, containing about 380 ppm Fe, is melted in a 7" diameter by 17" (17.78 cm by 43.18 cm) long cylindrical steel container under a protective atmosphere of air/$CO_2$/$SF_6$. An electric resistance heated furnace is used to control the melt temperature at 700° C. The melt is sparged with propane gas in order to saturate it with dissolved hydrogen. A hollow steel tube (ID=0.64 cm) is used for gas sparging. Six liters of propane gas is added over a 15 minute period. Next, the metal is degassed by sparging with 142 liters of argon through the tube over a 30 minute time period to remove at least a portion of dissolved hydrogen gas. After degassing, 2500 ppm Zr and 550 ppm Si are added. The metal is stirred for 10 minutes using a mechanical mixer. Next the melt, in quiescent state, is settled for 2 hours. The heating elements are shut off, and the metal is allowed to solidify undisturbed to produce a billet.

Figure 3:
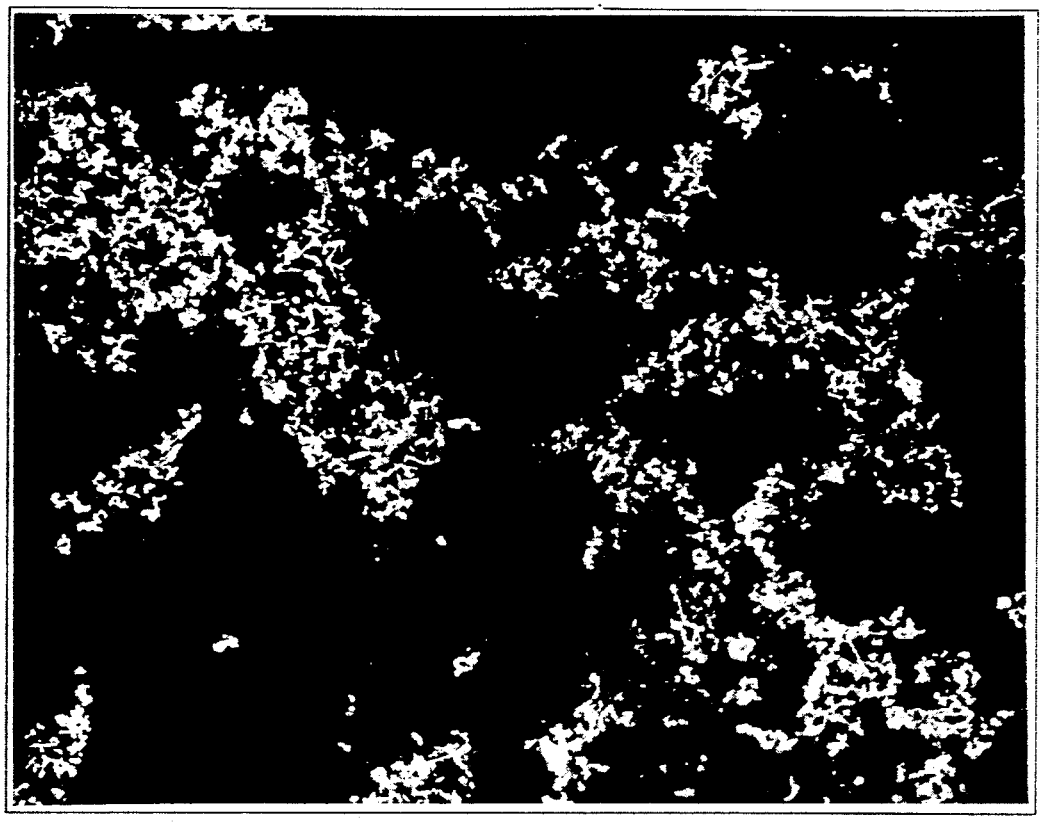
FIG. 3 is a 500× magnification of binary and ternary (mostly ternary) intermetallic compounds of Fe, Zr, and Si.

The solid billet is removed from the steel container the next day. Pin samples are drilled from the top of the billet and analyzed by spark emission spectrophotometry. The samples are found to contain 29 ppm Fe, 7 ppm Zr, and 227 ppm Si. The billet is sectioned for metallographic analysis. The billet is found to contain a 5.72 cm thick layer along its bottom which is rich in settled intermetallic particles. The settled layer is found to contain only a few large ring structures. The rings are similar to those seen in Example 2 above. In addition, the settled layer in this comparative example is found to contain no alpha-Fe particles, and is found to contain many discrete micron sized particles (see FIG. 3). XRD analysis indicates that the particles are rich in Fe, Zr, and Si. A sample from the bottom of the billet is dissolved in concentrated aqueous $NH_4Cl$ solution, and an insoluble black powder is recovered and analyzed by powder x-ray diffraction (XRD). The major phase identified by XRD is FeSiZr. No other phases are positively identified.

Figure 4:
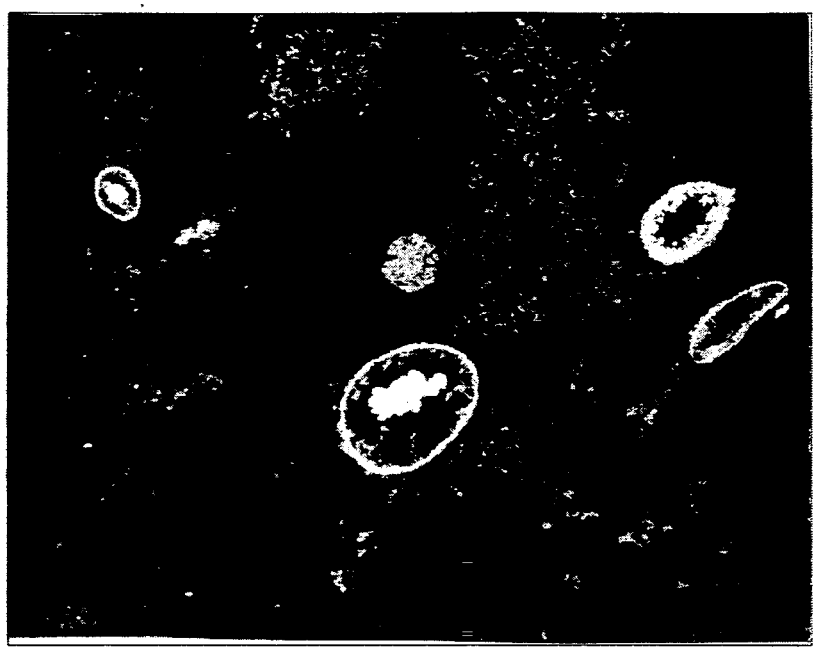
FIG. 4 is a 500× magnification of binary and ternary (mostly ternary) intermetallic compounds of Fe, Zr, and Si. The binary and ternary intermetallic compounds are present along with a few bead structures which contain $ZrH_2$.

In this example, a low-iron product is successfully produced. At least a portion of the dissolved hydrogen gas is removed by argon sparging of the melt. As a result, enough Zr is available to precipitate almost all of the Fe as a ternary intermetallic compound, in this case Fe/Si/Zr. Evidently, the degassing was not carried to completion since some $ZrH_2$ is present in the ring structure, permitting the high residue of soluble Si in the Mg product samples. (see FIG. 4)

EXAMPLE 3: (example to compare with Ex. 4)

About 10,000 pounds (4536 Kg) of molten Mg, treated with Zr and Si in accordance with the methods described in U.S. Pat. No. 4,891,065 are held in a large reverberatory furnace; the metal contains low levels of soluble Fe (9 ppm), Zr (42 ppm), and Si (44 ppm). The slag layer on the bottom of the furnace contains settled intermetallic particles. In a large steel crucible of 8,000 pounds (3629 Kg) capacity, a batch of the molten Mg is treated with Zr and Si as in U.S. Pat. No. 4,891,065. Samples obtained from the pot, after only 10 minutes of settling, are found to contain 29 ppm Fe, 200 ppm Zr, and 23 ppm Si. The Zr is evidently not soluble Zr since one typically obtains a reduction of the Zr simply by increasing the settling time. We find the high level of Zr in the sample obtained from the large steel pot is due to $ZrH_2$ inclusions. About 6,000 pounds (2721 Kg) of metal is then transferred from the steel pot to the reverberatory furnace. After the transfer, the metal is held undisturbed in order to allow the insoluble solid particles to settle to the bottom of the furnace. Samples of molten metal are taken from the reverberatory furnace at the start and end of the metal transfer and thereafter as shown in the data below, which also shows the metal analysis, as measured by spark emission spectrophotometry.

| Time (min.) of sample | Fe (ppm) | Zr (ppm) | Si (ppm) |
|---|---|---|---|
| 0 (start of transfer) | 9 | 42 | 44 |
| 20 (end of transfer) | 29 | 271 | 46 |
| 25 | 27 | 217 | 39 |
| 30 | 25 | 216 | 38 |
| 35 | 24 | 190 | 34 |
| 40 | 21 | 164 | 33 |
| 45 | 23 | 170 | 30 |
| 50 | 20 | 144 | 28 |
| 111 | 22 | 102 | 24 |
| 115 | 19 | 85 | 21 |

As can be seen in the above data, the Zr content rises from 42 ppm to 271 ppm during the transfer of the molten Mg, and it does not drop below 145 ppm until 30 minutes after the transfer is complete. The Fe and Si contents are almost constant in comparison. These results are evidence that there is a readily suspendable (but slow settling) Zr-rich phase which contains little Fe or Si. The analytical results indicate the Zr-rich comprises $ZrH_2$.

EXAMPLE 4: (example of invention to compare with Ex. 4)

About 10,000 lbs. (4536 kg) of molten Mg, treated with Zr and Si in accordance with the methods described in '065 patent are held in a large reverberatory furnace; the metal contains low levels of soluble Fe (11 ppm), Zr (53 ppm), and Si (73 ppm). The slag layer on the bottom of the furnace contains settled intermetallic particles. In a large steel crucible of 8,000 lbs. (3629 kg) capacity, a batch of the molten Mg is first degassed by bubbling argon gas through the melt at a flow rate of 500 scfh (3.93 liters/sec) for 10 minutes using rotary impeller degassing.

Next, the molten Mg is treated with Zr and Si as in the '065 patent. Samples obtained from the pot, after only 10 minutes of settling, are found to contain 3 ppm Fe, 42 ppm Zr, and 41 ppm Si. the relatively low Zr content (as compared to Example 3) is due to a significant reduction in the amount of $ZrH_2$ formed. About 6,000 lbs. (2721 kg) of metal is then transferred from the steel pot to the reverberatory furnace. After the transfer, the metal is held undisturbed in order to allow the insoluble solid particles to settle to the bottom of the furnace. Samples of molten metal are taken from the reverberatory furnace at the start and end of the metal transfer and thereafter as shown in the data below, which also shows the metal analysis, as measured by spark emission spectrophotometry.

| Time (min.) of sample | Fe (ppm) | Zr (ppm) | Si (ppm) |
|---|---|---|---|
| 0 (start of transfer) | 7 | 20 | 72 |
| 20 (end of transfer) | 10 | 120 | 65 |
| 25 | 11 | 98 | 60 |
| 30 | 12 | 83 | 63 |
| 35 | 15 | 65 | 55 |
| 40 | 10 | 39 | 50 |
| 45 | 9 | 19 | 58 |
| 50 | 7 | 21 | 58 |

As can be seen in the above data, the Zr content rises from 20 ppm to 120 ppm during the transfer of the molten Mg. The Fe and Si contents are almost constant in comparison.

Example 4 is compared to Example 3 in FIG. 5. Due to the use of a degassing treatment in Example 4, much less slow-settling $ZrH_2$ particle phase is formed as compared to Example 3. As a result, the magnitude of the Zr spike in FIG. 5 is much smaller for Example 4 than for Example 3. Since the incidence of suspended $ZrH_2$ inclusions is reduced by degassing, an improved process for consistently producing a high purity, low iron Mg metal product is obtained.

The examples described above illustrate particular embodiments of the present invention, but the invention is limited only by the following claims. Other persons skilled in these relative arts, after learning of this invention, may demonstrate other illustrations or examples without departing from the inventive concept involved here.

What is claimed is:

1. A process for producing high purity magnesium low in iron contamination, said process essentially comprising:
   (a) degassing molten Mg which contains iron, while under a protective flux or protective atmosphere, to purge out at least an appreciable amount of hydrogen present in the Mg,
   (b) introducing Zr and Si material to the molten Mg in amounts and ratios sufficient to form
      (i) a ternary intermetallic of Fe, Zr and Si with the iron in the Mg, and
      (ii) a binary intermetallic of Si and Zr, both the ternary and binary intermetallic compounds precipitating as rapidly-settling precipitates, and
   (c) separating the precipitates from the magnesium melt to recover magnesium which is of high purity and low iron content, the recovered magnesium being essentially free of suspended $ZrH_2$ by way of having been degassed to remove at least an appreciable amount of the hydrogen from the Mg.

2. The process of claim 1 wherein the degassing is performed by using at least one of the techniques of the type known as gas sparging, vacuum fluxing, rotary impeller degassing, and treatment with a volatile chlorocarbon.

3. The process of claim 1 wherein the degassing is performed by using gas sparging.

4. The process of claim 1 wherein the degassing is performed by using gas sparging with a lance, a porous plug, or a rotary impeller degassing unit.

5. The process of claim 1 wherein the degassing is performed by gas sparging using a lance.

6. The process of claim 1 wherein the degassing is performed by gas sparging using a porous plug.

7. The process of claim 1 wherein the degassing is performed by gas sparging using a rotary impeller degassing unit.

8. The process of claim 1 wherein the degassing is performed by using vacuum fluxing.

9. The process of claim 1 wherein degassing is done using a sparging gas which comprises argon or helium as at least the predominant portion of the gas.

10. The process of claim 1 wherein the degassing is done using a sparging gas which comprises argon and chlorine.

11. The process of claim 1 wherein the sparging gas comprises argon and a volatile chlorocarbon compound.

12. The process of claim 1 wherein the sparging gas comprises argon and hexachloroethane.

13. The process of claim 1 wherein the Zr is furnished in the molten Mg as binary Zr/Mg.

14. The process of claim 1 wherein the Zr is furnished in the molten Mg as binary Zr/Mg in which the Zr comprises a predominant portion of the binary.

15. The process of claim 1 wherein the Zr is furnished in the molten Mg as binary Zr/Mg in which the Mg comprises a predominant portion of the binary.

16. The process of claim 1 wherein the Zr is furnished into the molten Mg as Zr sponge.

17. In a process in which molten Mg is contacted with a zirconium material and a silicon material to reduce the iron contamination by precipitating a ternary intermetallic compound as a precipitate comprising Zr, Si, and Fe, the improvement which comprises degassing the molten Mg, under a protective flux or protective atmosphere, to remove at least an appreciable amount of hydrogen from the Mg prior to contacting the Mg with the Zr and Si to form the intermetallic precipitate, and separating the resulting low-iron Mg from the precipitate, said degassing thereby averting to a significant and appreciable extent the formation of relatively slow-settling $ZrH_2$, thus obtaining a more efficient and speedier recovery of low-iron, highly pure Mg.

18. The process of claim 17 wherein the degassing is performed by using at least one of the techniques of the type known as gas sparging, vacuum fluxing, and rotary impeller degassing.

19. The process of claim 17 wherein the degassing is performed by using gas sparging.

20. The process of claim 17 wherein the degassing is performed by using vacuum fluxing.

21. The process of claim 17 wherein the degassing is performed by using rotary impeller degassing.

22. The process of claim 17 wherein degassing is done using a sparging gas which comprises an inert gas of the group consisting of argon and helium as the predominant portion of the gas.

23. The process of claim 17 wherein the degassing is done using a sparging gas which comprises argon and chlorine.

24. The process of claim 17 wherein the sparging gas comprises argon and a volatile chlorocarbon compound.

25. The process of claim 17 wherein the sparging gas comprises argon and hexachloroethane.

26. The process of claim 17 wherein the Zr is furnished in the molten Mg as sponge Zr or as binary Zr/Mg in which either the Zr or the Mg comprises the predominant portion of the binary.

* * * * *